United States Patent [19]

Sato

[11] 4,292,894

[45] Oct. 6, 1981

[54] CONSTANT PRINTING PRESSURE MECHANISMS FOR LABEL PRINTING MACHINE

[75] Inventor: Yo Sato, Tokyo, Japan

[73] Assignee: Kabushiki Kaisha Sato Kenkyusho, Japan

[21] Appl. No.: 87,315

[22] Filed: Oct. 22, 1979

Related U.S. Application Data

[60] Division of Ser. No. 866,991, Jan. 5, 1978, Pat. No. 4,207,816, which is a continuation-in-part of Ser. No. 819,103, Jul. 26, 1977, abandoned.

[30] Foreign Application Priority Data

Jul. 29, 1976 [JP] Japan ..... 51-089701
Jan. 8, 1977 [JP] Japan ..... 52-0505

[51] Int. Cl.[3] ..... B41J 5/00
[52] U.S. Cl. ..... 101/291
[58] Field of Search ..... 101/288, 291, 295

[56] References Cited

U.S. PATENT DOCUMENTS

| | | | |
|---|---|---|---|
| 1,064,674 | 6/1913 | Ursbruck | 400/460.2 |
| 3,197,011 | 7/1965 | Kuramachi | 400/480 |
| 3,362,326 | 1/1968 | Delpo et al. | 101/316 |
| 3,729,080 | 4/1973 | Mueller | 400/457 |
| 3,902,952 | 9/1975 | Penaluna | 101/295 |
| 3,911,817 | 10/1975 | Becker | 101/291 |
| 4,208,964 | 6/1980 | Sato | 101/291 |

FOREIGN PATENT DOCUMENTS

| | | | |
|---|---|---|---|
| 77925 | 7/1949 | Czechoslovakia | 400/435 |

*Primary Examiner*—William Pieprz
*Attorney, Agent, or Firm*—Ostrolenk, Faber, Gerb & Soffen

[57] ABSTRACT

A constant printing pressure mechanism for a label printing machine: in one embodiment, a pressure applying roller is attached to the free ends of the yokes or printing levers that support the printing head; a resilient pressure receiving member which is pivotally supported on the machine frame and is abutted by the pressure roller; when the hand lever is squeezed, the pressure roller is pressed to the pressure receiving member; when the force of the pressure roller both pivots the receiving member a permitted maximum distance and overcomes the compressive stress in the resilient pressure receiving member and deflects the member, then the printing stroke is effected; in another embodiment, the pressure applying roller is on the frame and the resilient pressure receiving means is on the hand lever; the pressure receiving means comprises: a supporting member attached to a hand lever; a pressure controlling member which is pivotally secured to the hand lever; a pressure receiving piece having a cam surface on the front side thereof and being pivotally secured to the pressure controlling member; and a spring member which is interposed between the supporting member and the pressure controlling member.

15 Claims, 16 Drawing Figures

CONSTANT PRINTING PRESSURE MECHANISMS FOR LABEL PRINTING MACHINE

CROSS-REFERENCE TO RELATED APPLICATIONS

This is a divisional of Ser. No. 866,991, filed Jan. 5, 1978, now U.S. Pat. No. 4,207,816 which is a continuation-in-part application of Ser. No. 819,103, filed July 26, 1977, and now abandoned.

BACKGROUND OF THE INVENTION

1. Field of the Invention

This invention relates to constant printing pressure mechanisms for a label printing and dispensing machine, particularly of the hand-held type (hereinafter referred to as a "label printing machine"). These machines are usually of the type in which each label piece of a pressure sensitive self-adhesive label strip is imprinted during the motion of the action levers of the machine.

2. Description of the Prior Art

In conventional constant printing pressure mechanisms, an inking means is urged by spring members toward the type faces that are disposed at the lower part of a printing head. The printing head is attached to printing levers. There is also a hand operated lever. The printing levers and the hand lever are usually separated formed from each other.

In these label printing machines, however, the force of the printing stroke against the label varies directly with the force of squeezing of the hand lever, so that the depths or darknesses of printed figures are liable to correspondingly vary. In order to eliminate this disadvantage, constant printing pressure mechanisms have been developed in recent years.

In some constant printing pressure mechanisms, use is made of the compressive action of a constant pressure spring that is provided between the hand lever and the printing levers. It is only the squeezing of the hand lever that increases the pressure of the constant pressure spring against the printing levers. When the spring pressure exceeds the control limit of the constant pressure mechanism, printing is initiated.

In another variation of such a mechanism, an inking device is rotatably mounted at the front portion of the label printing machine and it has a return spring that brings the inking device into contact with the type faces of a printing head. In this mechanism, when the hand lever is squeezed, the printing head is depressed and this moves the inking device aside against the force of a return spring. Only when the downward force of the printing levers that are pressed by a compression spring exceeds the control limit of the return spring, is the label printing performed. Accordingly, the printing stroke is effected only by the compression spring, and label printing at a constant pressure can be attained, regardless of the intensity of the squeezing of the hand lever. Printed figures of even darkness can be obtained.

The foregoing constant pressure mechanisms only use springs in the printing levers. The force of these springs is liable to become weaker through repeated use. This weakens the force of the printing strokes. As a result, the conventional constant printing pressure mechanisms do not print labels with constant depth of printed characters.

Further, in conventional structures, high precision printing of labels cannot be attained since double printing is caused by the rebounding or bouncing of the printing head on the platen.

Furthermore, conventional printing mechanisms print for an unpredictable time period dependent upon the duration of the squeezing of the hand lever. When the hand lever is squeezed for too long a time, the type faces of the printing head are held too long in contact with the label then on the platen. Excess ink is absorbed by the label surface, which results in blurring of the ink.

It has become necessary in recent years to read information printed on labels optically as the P.O.S. (point of sales) system has become widely adopted. Therefore, labels must be printed quite precisely in order to be readable by optical character reading machines. For this purpose, it has become necessary to provide the label printing machine with two or more inking rollers so as to apply ink evenly to the type faces of a printing head, and/or with guide means for guiding the inking rollers to roll over the type faces under a constant pressure.

The structure of label printing machines becomes complicated with known constant printing pressure mechanisms and the label printing machines become expensive for general use.

BRIEF SUMMARY OF THE INVENTION

It is the primary object of the present invention to provide a durable constant printing pressure mechanism for a label printing machine.

It is another object of the invention to facilitate constant printing pressure for a long period.

It is a further object of the invention to eliminate blurring of the label imprint.

It is yet another object of the invention to have each label imprinting occur in a constant time period.

It is another object of the invention to prevent double or rebound printing of a label.

Another object of the invention is to provide a constant printing pressure mechanism with which the label printing can be performed at a predetermined printing pressure, regardless of the squeezing force on the hand lever.

A further object of the invention is to provide a constant printing pressure mechanism which leaves space for a plurality of type face inking rollers in the machine frame.

Still a further object of the present invention is to provide a constant printing pressure mechanism with which the label printing without unevenness of depths of printed figures can be attained.

Furthermore, the object of the present invention is to provide a constant printing pressure mechanism which is simple in structure and made at low cost.

In view of the above, the constant printing pressure mechanism of one embodiment of the present invention comprises a pressure applying roller attached to the free ends of the yokes or printing levers that support the printing head and resilient pressure receiving members which are pivotally supported on the machine frame and are urged in a direction to push up the printing head. The pressure roller is pressed to the pressure receiving members upon the squeezing of the hand lever. When the force of the pressure roller exceeds the compressive stress in the pressure receiving members, the printing stroke is effected.

The resilient pressure receiving members comprise a combination of a pressure receiving piece having a pressure receiving projection and pressure controlling arms. Both the pressure receiving piece and the pressure controlling arms are pivotally supported by interposing a spring member between them. The depressing force that should be exerted on the printing levers is controlled by adjustment of the pressure controlling arms to limit the extent to which the pressure receiving member may pivot. Adjustable screws attached to the controlling arms engage a contact pin when the pressure roller is pressed against the pressure receiving piece by the squeezing of hand lever and the pressure receiving member has pivoted to the desired extent. Further squeezing of the hand lever causes the pressure applying roller on the printing levers to deform the resilient pressure receiving piece and to eventually snap past the resilient piece, thereby to always imprint a label with a preset pressure.

In the present invention, the printing levers and the hand lever are integral so as to endure repeated uses and to facilitate constant printing pressure for a long period.

Further, in a second embodiment of the constant printing pressure mechanism of the present invention, immediately after imprinting, the printing head is slightly raised from the platen so as to prevent the double imprinting which could occur immediately after the printing stroke.

The above noted raising means for the printing head also prevents the blurring of ink due to too prolonged inking. When the printing head is raised from the platen immediately after the printing, regardless of the duration of a squeezing of the hand lever, such blurring can be avoided.

A returning means to raise the printing head from the platen immediately after the printing of a label comprises leaf springs that are supported on the machine frame and that are engaged by lug pieces of the descending printing head. The leaf springs exert upward force on the printing head lug pieces. The lug pieces are attached to the side walls of the printing head at positions corresponding to the positions of the leaf springs.

In the foregoing embodiments, the constant printing pressure mechanism is at the front end of the printing levers. However, where plural inking rollers must be used, the mechanism fills the space that may be needed for these rollers.

The third embodiment of the constant printing pressure mechanism of the present invention overcomes the foregoing problem. It comprises: a supporting member which is attached to a hand lever, a pressure controlling member which is pivotally secured to the hand lever and which may turn only in the direction toward the supporting member, a pressure receiving piece which is provided with a cam surface on the front side thereof and which is pivotally secured to the above pressure controlling member so as to be turned only upward, a spring member which is interposed between the supporting member and the pressure controlling member and a pressure applying member which is attached to a hand grip and brought into contact with the cam surface formed on the pressure receiving piece when the hand lever is squeezed.

The constant pressure printing mechanisms of the present invention are quite advantageous in a system in which high precision printing is required, such as a P.O.S. (point of sales) system where labels are read out automatically by optical character readers.

BRIEF DESCRIPTION OF THE DRAWINGS

The foregoing and other objects and features of the present invention will be more apparent from the following description taken in connection with the accompanying drawings, in which:

FIG. 1 to FIG. 5 show a first embodiment of a constant printing pressure mechanism according to the invention, in which:

FIG. 1 is a perspective view of a label printing machine which is provided with a constant printing pressure mechanism according to the present invention;

FIG. 2 is a vertical cross-sectional side view of the machine in the rest position, in which the machine frame on the viewing side is removed;

FIG. 3 is a partially cross-sectional side view of a printing head in the pressure receiving position;

FIG. 4 is a partially cross-sectional side view of the printing head in the printing position.

FIG. 5 is an exploded perspective view of the first embodiment of the pressure receiving means of the present invention;

FIG. 6 to FIG. 12 show a second embodiment of a constant printing pressure mechanism according to the present invention, in which:

FIG. 6 is an exploded perspective view of the main portion of this embodiment of the mechanism;

FIG. 7 is a partially cross-sectional side view of the printing head in the rest position;

FIG. 8 is a partially cross-sectional side view of the printing head in the printing position;

FIG. 9 is a partially cross-sectional side view in which the printing head is slightly lifted immediately after the printing;

FIG. 10 is a vertical cross-sectional front view of the printing head and corresponding to the position shown in FIG. 7;

FIG. 11 is a vertical cross-sectional front view of the printing head and corresponding to the position shown in FIG. 8;

FIG. 12 is also a vertical cross-sectional front view of the printing head and corresponding to the position shown in FIG. 9;

FIGS. 13–16 show a third embodiment of a constant printing pressure mechanism according to the invention, in which:

FIG. 13 is a side view of a label printing machine which is provided with the third embodiment of constant printing pressure mechanism of the present invention, with the machine in the rest position and the machine being shown with the machine frame on the near side removed;

FIG. 14 is also a side view of the machine in the pressure receiving state;

FIG. 15 is a side view of the machine in the printing state; and

FIG. 16 is an exploded perspective view of the constituent members of the constant printing pressure mechanism in accordance with the present invention.

DETAILED DESCRIPTION OF THE PREFERRED EMBODIMENTS

Figure 1:
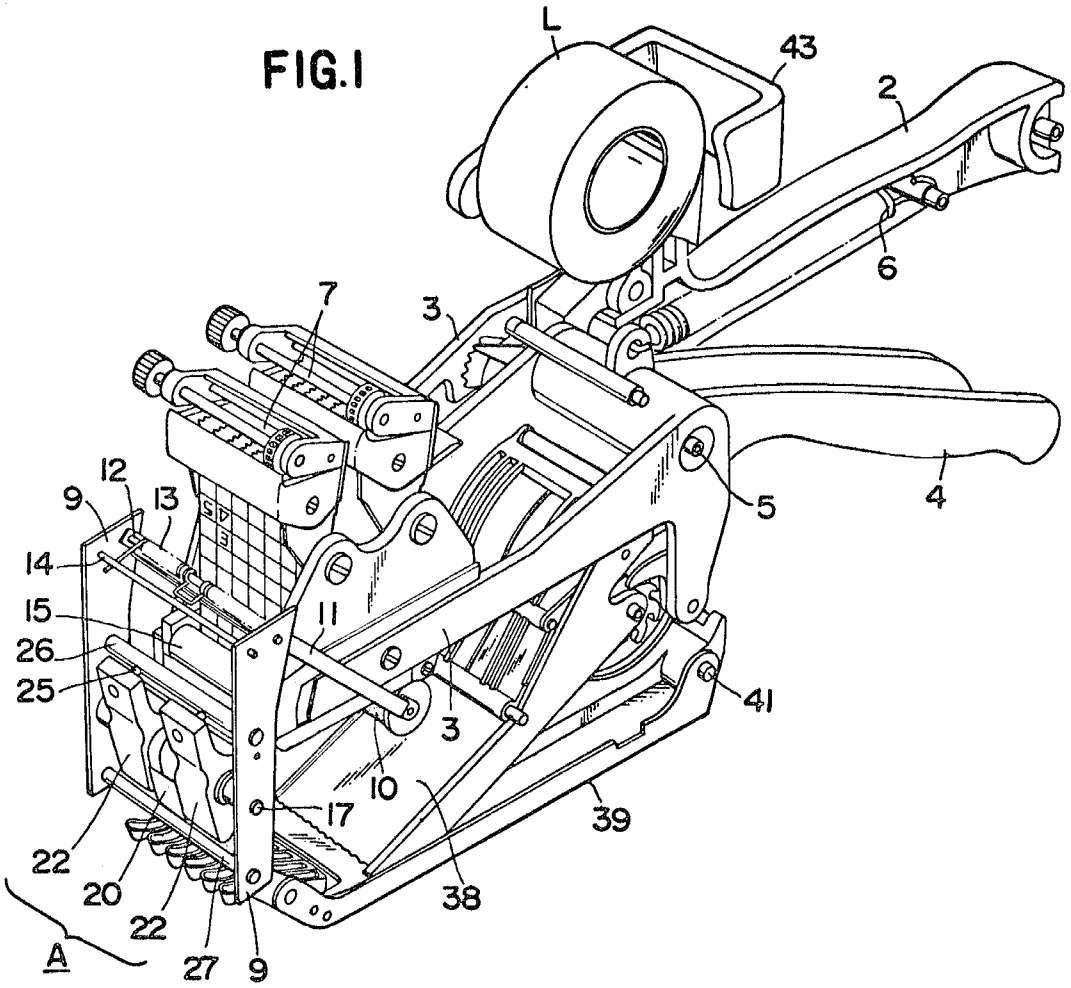
Figure 2:
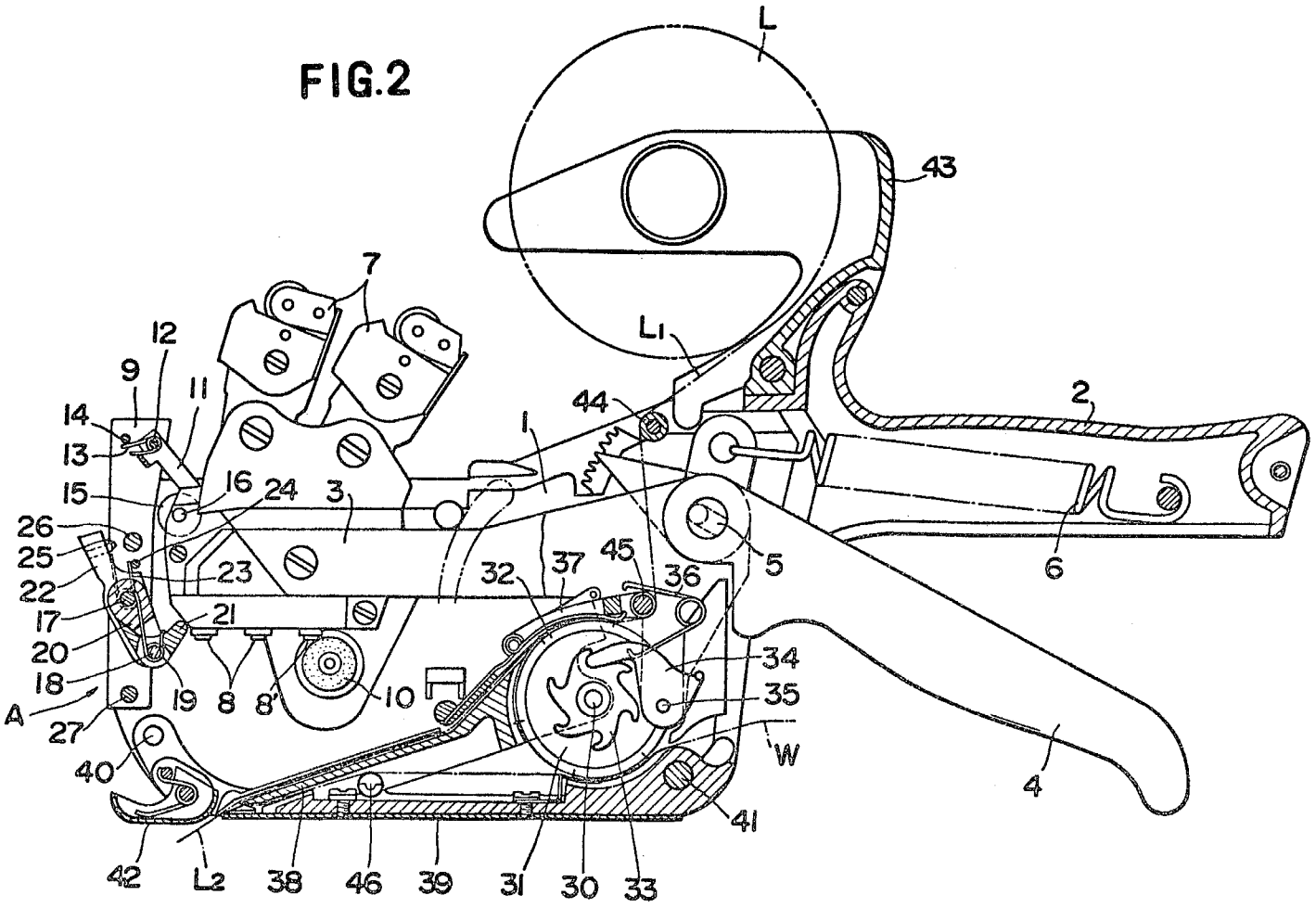

A first embodiment of a constant printing pressure mechanism of the present invention is shown in FIGS. 1–5. As shown in FIGS. 1 and 2, the printing machine is supported by and between a pair of spaced apart machine frames 1 that are formed on both sides of the machine body. The printing machine includes printing levers 3 or yokes, comprised of a pair of side plates which are disposed on the insides of the machine frames 1. The printing levers 3 are formed integrally with the hand lever 4. The free front ends of the printing levers 3 carry printing heads 7. The rear ends of the printing levers 3 are pivotally secured to the rear portion of the machine frames 1. The front ends of the levers 3 are always urged upward by a spring 6 that is stretched between a hand grip 2 and a hand lever 4.

Figure 5:
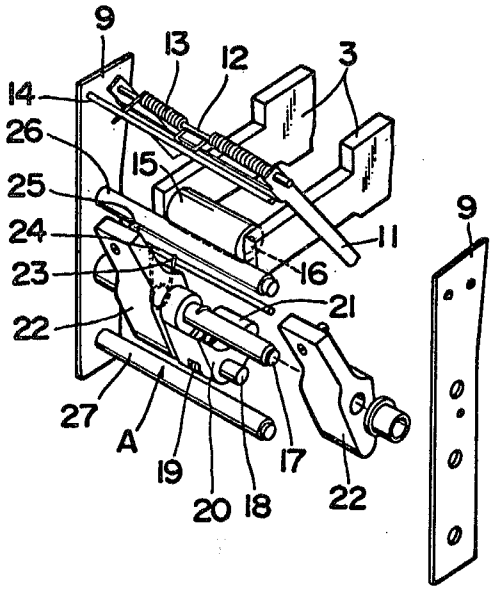
Figure 8:
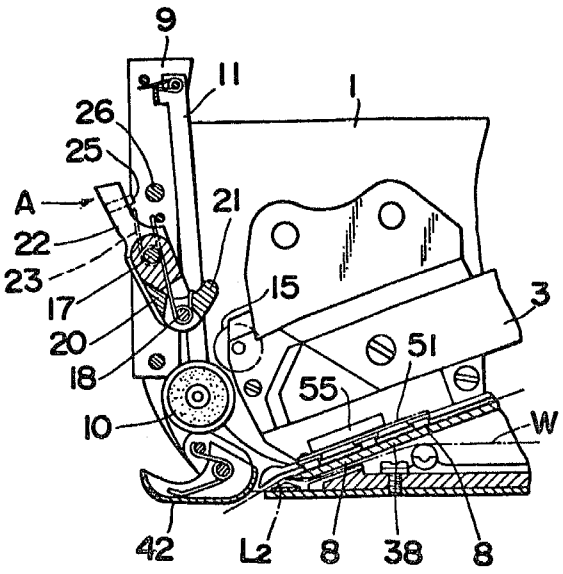

As shown in FIGS. 1, 2 and 5, a pressure roller 15 is rotatably attached to a shaft 16 located at the front end portions of the printing levers 3. The pressure roller 15 is brought into engagement with below described pressure receiving members A. Near the front ends of the printing levers 3, the machines frames 1 are provided with a pair of supporting plates 9, one attached on each frame 1.

Between the upper portions of the supporting plates 9, there is a supporting shaft 12 for an inking roller 10. Forward of shaft 12, there is a spring contact pin 14 on plates 9. At the ends of the supporting shaft 12 are attached a pair of rearwardly and downwardly extending arms 11 that carry the inking roller 10 between them. In the rest position of FIG. 1, the inking roller 10 is urged toward the type faces 8 of the printing head 7 or the type faces 8' of code plates next to the type faces 8 by the force of the spring 13 wrapped around shaft 12.

The main part of pressure receiving members A comprise a central pressure receiving piece 20 and a pair of pressure controlling arms 22 flanking piece 20. All of these are disposed between the supporting plates 9 and all are made of an elastic, resilient, synthetic plastic material. The controlling arms 22 are pivotally mounted on a supporting shaft 17 which is held between the supporting plates 9. The pressure receiving piece 20 is supported by a pair of protruding portions of a supporting shaft 18. The protruding portions of the shaft 18 are pivotally secured to the pair of controlling arms 22.

The pressure receiving piece 20 is provided with a pressure receiving projection 21 that extends toward the printing levers 3 and across the path of descent of roller 15. Projection 21 is urged in the counterclockwise direction, to push the printing head 7 upward or clockwise, by a spring 19 that is attached to the supporting shaft 18. The pressure receiving piece 20 turns together with the pressure controlling arm 22. During the return movement of the printing levers 3, after a label has been printed by the printing head 7, and when the pressure roller 15 at the forward end portions of printing levers 3 is returned, only the pressure receiving piece 20 is momentarily turned aside in the clockwise direction against the force of the spring 19.

The pressure controlling arms 22 are urged normally counterclockwise to their position of FIG. 2 by a spring 23 which is held by the supporting shaft 17 and a spring support pin 24. The inside surface at the upper end of each controlling arm 22 is provided with an adjustable length screw 25. During printing machine operation, the adjustable screws 25 are brought into engagement with a contact pin 26 that extends between the supporting plates 9. The extent to which screw 25 extends toward contact pin 26 from the inside surface of controlling arm 22 correspondingly adjusts the distance the projection 21 of pressure receiving piece 20 extends across the path of roller 15. In this manner, the degree of pressing of the projection 21 against the pressure roller 15 can be controlled. Before a printing stroke is completed, the pressure receiving piece pivots to the maximum extent the screws 25 permit and then the resilient piece 20 must deflect out of the path of roller 15. The more the projection 21 extends into the pathway of roller 15, the more force required for the deflection. As a result, the desired pressing effect between the pressure receiving projection 21 and the pressure roller 15 can be obtained. More particularly, printing occurs when the pressure exerted by the pressure roller 15 exceeds the counter pressure exerted by the pressure receiving piece 20.

The contact pin 26 holds the supporting plates 9 together. A support pin 27 that is disposed below pin 26 also holds the plates. Both ends of the pins 26 and 27 are secured to the supporting plates with screws.

With reference to FIGS. 1 and 2, the structure of a label printing machine having the above noted constant printing pressure mechanism is now described:

A rolled label strip L is supported by a label holder 43. The tape-like label strip $L_1$ of the rolled label strip L is advanced intermittently the length of one label at a time, over the guide rollers 44 and 45, by a feeding device, and they are delivered onto the platen 38. After a label is printed by the printing head 7, a printed label $L_2$ is peeled off its backing layer and is applied to the surface of an article to be labeled.

The label strip feeding device is now described. A rotary shaft 30 is disposed between the machine frames 1. A rotary drum 31, having a one-way rotation clutch bearing and a ratchet wheel 33 on one side of the drum 31, are supported by the rotary shaft 30. Around the peripheral surface of the rotary drum 31 are disposed feeding projections 32, which engage in the cuts or perforations formed at spaced intervals along the label strip $L_1$. A ratchet 34 is brought into engagement with the ratchet wheel 33. The ratchet 34 is pivotally supported on a supporting shaft 35, and it is urged toward the ratchet wheel 33 by a spring 36.

A label strip holding member 37 is attached above the upper side of the rotary drum 31. A platen 38 is pivotally supported by the rotary shaft 30 and includes an upper surface opposable to the types 8, 8' of the print head 7. A label applicator 42 is disposed on the front side of the label holding member 37. Beneath the bottom side of the platen 38 is disposed a bottom cover 39, which is pivotally secured to a fulcrum shaft 40 that is attached to the front portion of the machine body. Further, a locking member 41 is attached to the rear portion of the machine body. Following separation of the label strip from its backing layer W, the backing layer is turned rearward near the front end of the platen 38, is then guided past a guide roller 46, and is brought into engagement with the feeding projections 32 at the underside of the rotary drum 31. The layer W is then passed out from the rear portion of the machine body.

Figure 4:
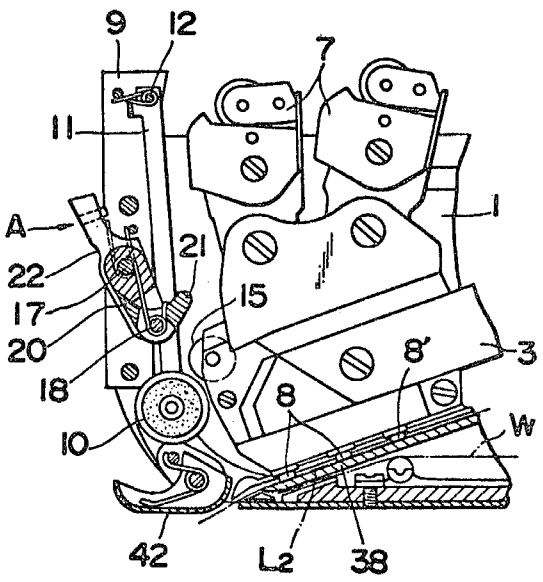

The operation of the first embodiment of the constant pressure printing mechanism is described with reference to FIGS. 2 to 4. When the hand grip 2 and the hand lever 4 are squeezed together, the printing levers 3 carrying the printing heads 7 are moved from the rest position of FIG. 2 into the depressed state of FIG. 3. The printing levers 3 are turned counterclockwise downward about the pivot shaft 5. This moves the inking roller 10 frontward and the type faces 8, 8' of the printing heads 7 are inked by the inking roller 10.

When the hand lever 4 is squeezed further, the pressure roller 15 at the front ends of the printing levers 3 contacts the pressure receiving projection 21 of the pressure receiving piece 20 and pivots it clockwise. The pressure controlling arms 22 are thereby turned clockwise about the supporting shaft 17 against the force of the spring 23 until the tip ends of the screws 25 at the upper portions of the arms 22 are brought into contact with the contact pin 26. Since both ends of the supporting shaft 18 for the pressure receiving piece 20 are attached to the pressure controlling arms 22, respectively, the pressure receiving piece 20 is also turned simultaneously with the turning of the pressure controlling arms 22.

Figure 3:
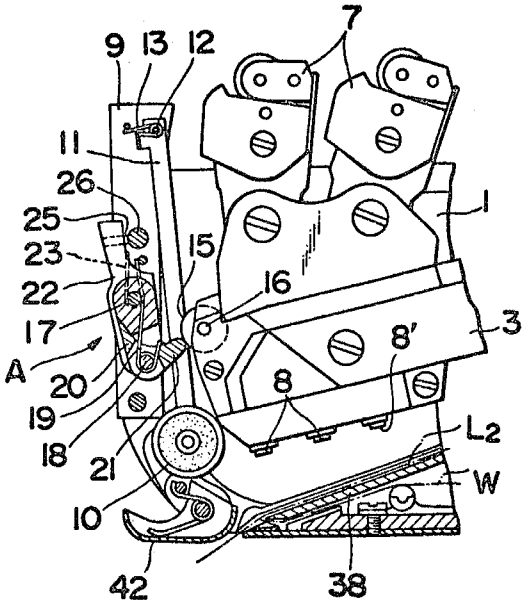

FIG. 3 shows the state of this turning action, in which the pressure roller 15 has been pressed against the tip end of the projection 21 of the resilient pressure receiving piece 20, while the upper side of this pressure receiving piece 20 and the pressure controlling arms 22 are forcibly pressed against the contact pin 26 through the adjustable screws 25. As a result, the tip end of the pressure receiving projection 21 is compressed and the pressure receiving piece 20 is distorted.

When the hand lever 4 is further squeezed strongly, the pressure of the pressure roller 15 eventually exceeds the compressive stress in the pressure receiving piece 20 and the pressure roller 15 rides or snaps over the pressure receiving projections 21. As shown in FIG. 4, the type faces 8 and 8' of the printing head 7 are then pressed against a label $L_2$ of the label strip $L_1$ on the platen 38, thereby printing the label.

When the hand lever 4 is next released, the printing levers 3 are returned to their original rest position of FIG. 2 by the contraction of the spring 6. In this action, the under surface of the pressure receiving projection 21 of the pressure receiving piece 20 is contacted by the pressure roller 15. However, the whole pressure receiving piece 20 can be turned aside in the clockwise direction against the force of the spring 19, so that the printing levers 3, which carry the printing head 7, can be moved into the rest position without any particular resistance.

The second embodiment of the constant printing pressure mechanism of the present invention is now described with reference to FIGS. 6 to 12. In this embodiment, the pressure receiving members A of the present invention are provided with returning members B (FIG. 6) for raising the printing head 7 immediately after its printing stroke. Since the pressure receiving members A of this embodiment and the printing machine itself have the same structure as in the first embodiment, the identical parts are indicated by the same reference numerals, and further description of their structures are omitted.

Figure 6:
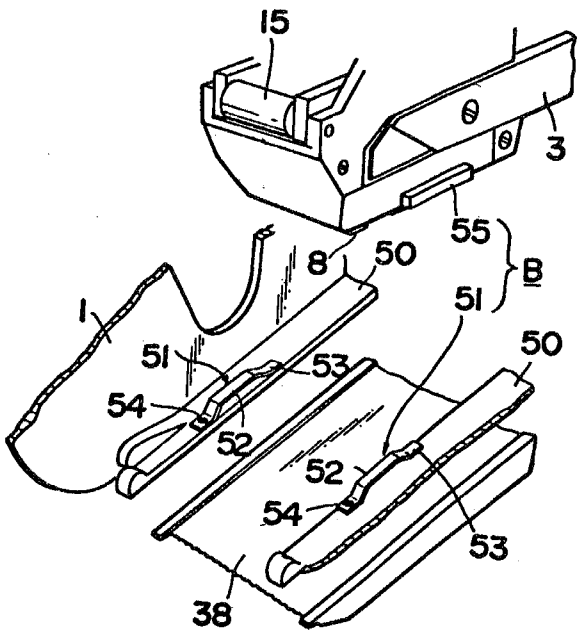

As shown in FIG. 6, the returning members B comprise leaf springs 51 attached to inwardly extending flanges 50 that project inwardly from the lower portions of the machine frames 1 and comprise the lug pieces 55 that are attached to the lower edges of the printing head 7. The positions of the lug pieces 55 overlie those of the leaf springs 51.

Each leaf spring 51 is comprised of a fixed front portion 54, a raised middle portion 52 and a sliding rear end 53. The front portion 54 of the leaf spring is fixed to the respective flange 50 by a fixing member, such as a screw. The sliding end 53 is arcuately curved upwardly so as to be slidable smoothly when the leaf spring 51 is depressed. The setting or charged position of the leaf spring 51 is made to coincide with the printing position of the platen 38. Further, the spring has such strength that the raised portion 52 may be flattened by the printing pressure exerted by the printing head 7.

Figure 7:
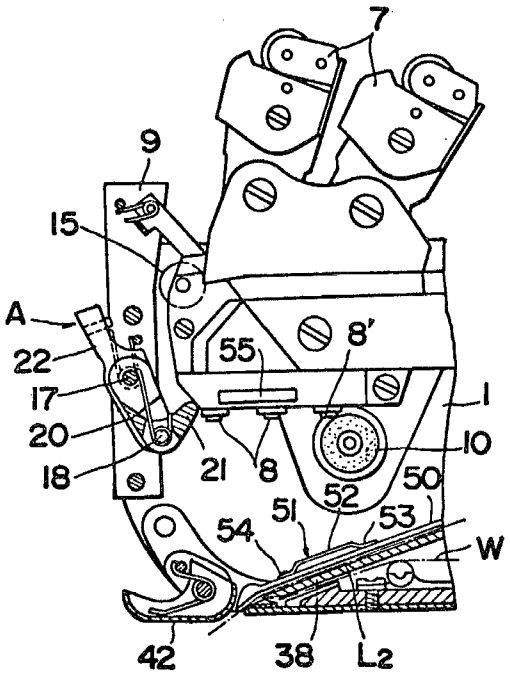
Figure 9:
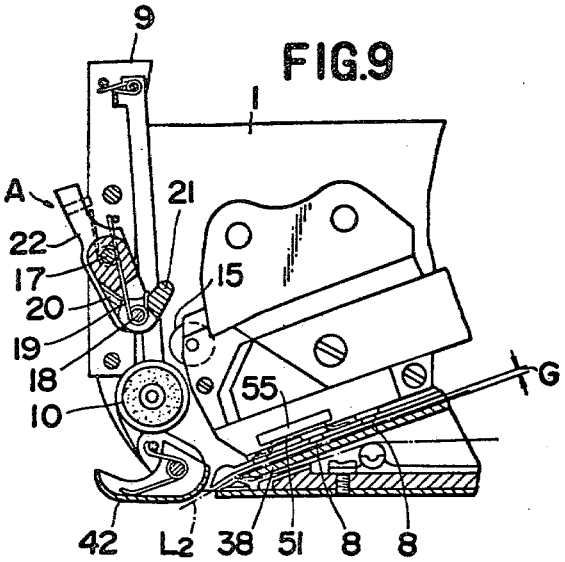
Figure 11:
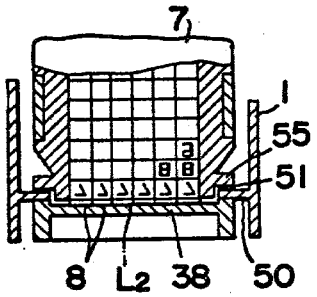
Figure 10:
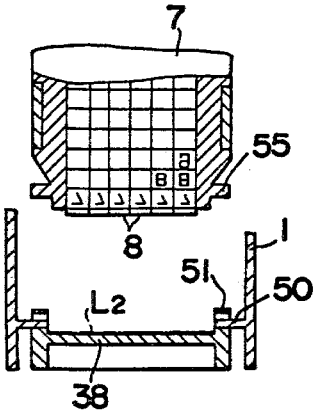

With reference to FIGS. 7 to 12, the printing and the returning of the printing head is now described. FIGS. 7 and 10 show the printing head 7 in the raised rest position. When the hand lever 4 is squeezed, the printing head 7 is moved into the printing position shown in FIGS. 8 and 11. More particularly, after the inking roller 10 has been rolled over the type faces 8 and 8', the pressure roller 15 on the printing levers 3 is brought into contact with the pressure receiving piece 20 of the pressure receiving members A to exert a compressive load on the pressure receiving projection 21. When the compressive load overcomes the compressive stress of the pressure receiving piece 20, the printing head 7 abruptly snaps down so that the type faces 8 and 8' are pressed against the label $L_2$ then being supported on the platen 38. During this printing stroke, the raised portions 52 of leaf springs 51 on both sides of the platen 38 are depressed and flattened by the lug pieces 55 on the printing head 7.

Figure 12:
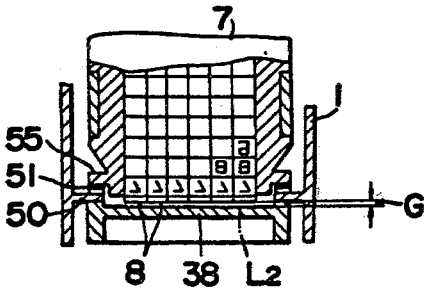

Immediately after the printing stroke, the printing head 7 is slightly lifted and the type faces 8 and 8' of the printing head 7 are raised from the printed label $L_2$ on the platen 38 through the resumption of their original form by the leaf springs 51, as shown in FIGS. 9 and 12. The restoring force of the leaf springs 51 also combines with the reaction to the printing stroke of the printing head 7. Thus, a small gap G is formed between the type faces 8 and 8' and the surface of printed label $L_2$.

When the hand lever 4 is later released, the printing head 7 is returned to its rest position of FIGS. 7 and 10 by the spring 6.

As described above, the pressure roller is attached to the printing levers that are integrally formed with the hand lever, and the pressure receiving members are supported on the machine frame and their spring force urges the printing head upward. Thus, only after the downward pressure of the pressure roller overcomes the compressive stress in the resilient pressure receiving members, is the printing stroke caused to occur.

Figure 13:
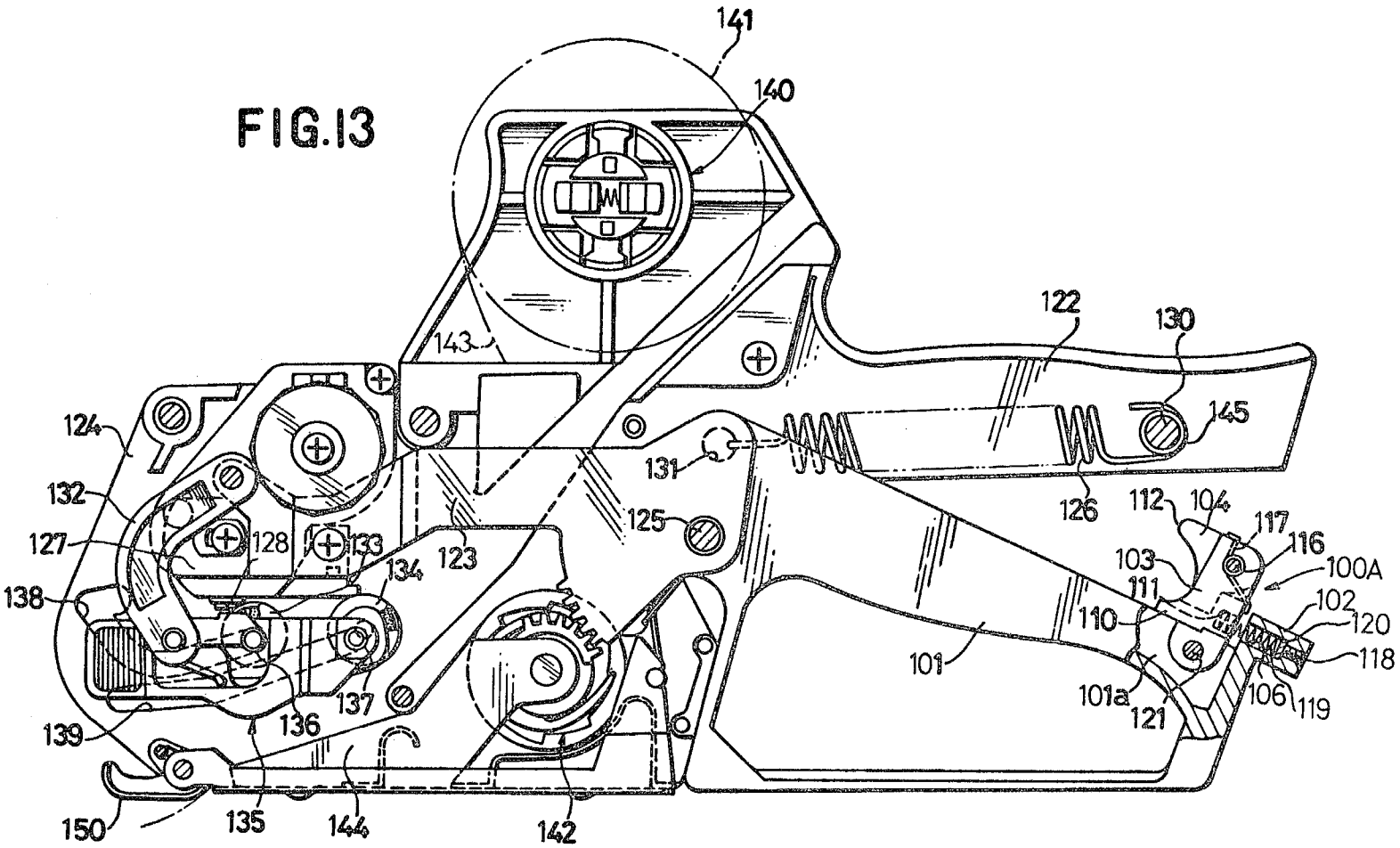

The third embodiment of the present invention is now described with reference to FIGS. 13–16. The constant printing pressure mechanism 100A is mounted on the rear end portion of a label printing machine, i.e. on the rear, right free end of a hand lever 101, as shown in FIG. 13. The mechanism 100A comprises a supporting member 102, a pressure controlling member 103 and a pressure receiving piece 104, which are shown in detail in FIG. 16.

The supporting member 102 is formed integrally with the rear end of the hand lever 101. In the upper part of the supporting member 102, a longitudinal screw hole 105 and a countersunk spring hole 106 are formed. Hole 106 has a larger diameter than screw hole 105. Together, the two holes 105 and 106 define a continuous path through the body of the supporting member 102.

In the lower part of the pressure controlling member 103, a bearing hole 149 is formed. The pressure controlling member 103 is pivotally secured between the side walls **101*a* of the hand lever 101 by a shaft 121 inserted into the bearing hole 149. In the upper portion of the pressure controlling member 103, a recess 107 having a raised shelf 107*a* at the bottom thereof is defined between a pair of side plates 108, each having a respective pin hole 109 therethrough placed near the tops of plates 108. The front lower portions (the left side in FIGS. 13 and 16) of the pressure controlling member 103 is provided with a raised forwardly projecting stopper 110**.

The rear surface of the member 103 has a spring hole 111 defined in it, which is similar to the hole 106.

The pressure receiving piece 104 has a forwardly projecting cam surface 112 on its front side and has a recess 113 in its rear side. In the side walls 114 of piece 104 on both sides of the recess 113, pin holes 115 are formed. The pressure receiving piece 104 is pivotally received within the recess 107 of the pressure controlling member 103 and actuated by a spring. A pin 116 is inserted into the aligned pin holes 109 and 115. A return spring 117 is fitted around the pin 116, and the spring urges the pressure receiving piece 104 counterclockwise around pin 116. This urges the cam surface 112 forwardly.

An adjusting screw 118 is fitted into the screw hole 105 of the supporting member 102. An adjusting spring 119 is set into the countersunk spring hole 106 of the supporting member 102 and also into the aligned spring hole 111 of the pressure controlling member 103. The rear end of the adjusting spring 119 is urged against the front face of the adjusting screw 118 by interposing a spring holding member 120 therebetween. The force that will be exerted by the adjusting spring 119 against the pressure controlling member 103 can be regulated by moving the adjusting screw 118 back and forth.

The label printing machine that includes the above described constant printing pressure mechanism is described with reference to FIGS. 13 to 15.

In the upper portion of the space between a pair of machine frames 124 on both sides of the machine body, there are printing levers 123. These are comprised of two side plates. The rear (right hand) ends of the printing lever 123 are pivotally secured to the rear portions of the machine frames 124 by a pivot shaft 125. At the rear side of the printing lever 123, there is integrally formed a hand lever 101. A return spring 126 is stretched between the spring pin 130 that is fixed on the rear part of the hand grip 122 and the spring hole 131 that is defined in the rear portion of the printing lever 123. The return spring 126 urges both the printing lever 123 and the hand lever 101 clockwise. The free, left end portion of the printing lever 123 carries a printing head 127.

A pair of swingable arms 132 is pivotally secured at their upper ends in FIG. 13 to the outside surfaces of the front end of printing lever 123. To the lowermost ends of the arms 132 are attached an inking roller holder 135 that carries rotatable inking rollers 133 and 134. On both sides of this inking roller holder 135, guide rollers 136 and 137 are attached at the positions respectively corresponding to the above inking rollers 133 and 134. In order to guide the motion of the guide rollers 136 and 137, guide grooves 138 and 139 are formed in the inside walls of the machine frames 124.

A label supporting device 140 rotatably supports a rolled label strip 141. A feeding device 142 passes a tape-like label strip 143 from the rolled label strip 141 to a platen 144 and, after a label has been printed, to a label applicator 150.

On both sides around the spring pin 130 that is formed on the inside of the hand grip 122, rollers 145 are rotatably fitted and they contact the cam surface 112 of the pressure receiving piece 104.

The operation of the constant printing pressure mechanism 100A of the present invention will be described with reference to FIGS. 13 to 15.

The hand grip 122 and the hand lever 101 start in the rest position shown in FIG. 13. When they are squeezed together, the printing lever 123 is turned counterclockwise (downward) about the fulcrum of the pivot shaft 125. In this action, the swingable arms 132 are turned clockwise and the inking roller holder 135 carried by the arms 132 is moved forward. Thus, the inking rollers 133 and 134 are rolled over the faces of types 128 that are disposed on the underside of the printing head 127. The guide rollers 136 and 137 are moved along the guide grooves 138 and 139 in this inking action. The inking rollers 133 and 134 are rolled over the faces of types 128 and exert a constant pressure so that ink can be applied to the type faces always evenly.

Figure 14:
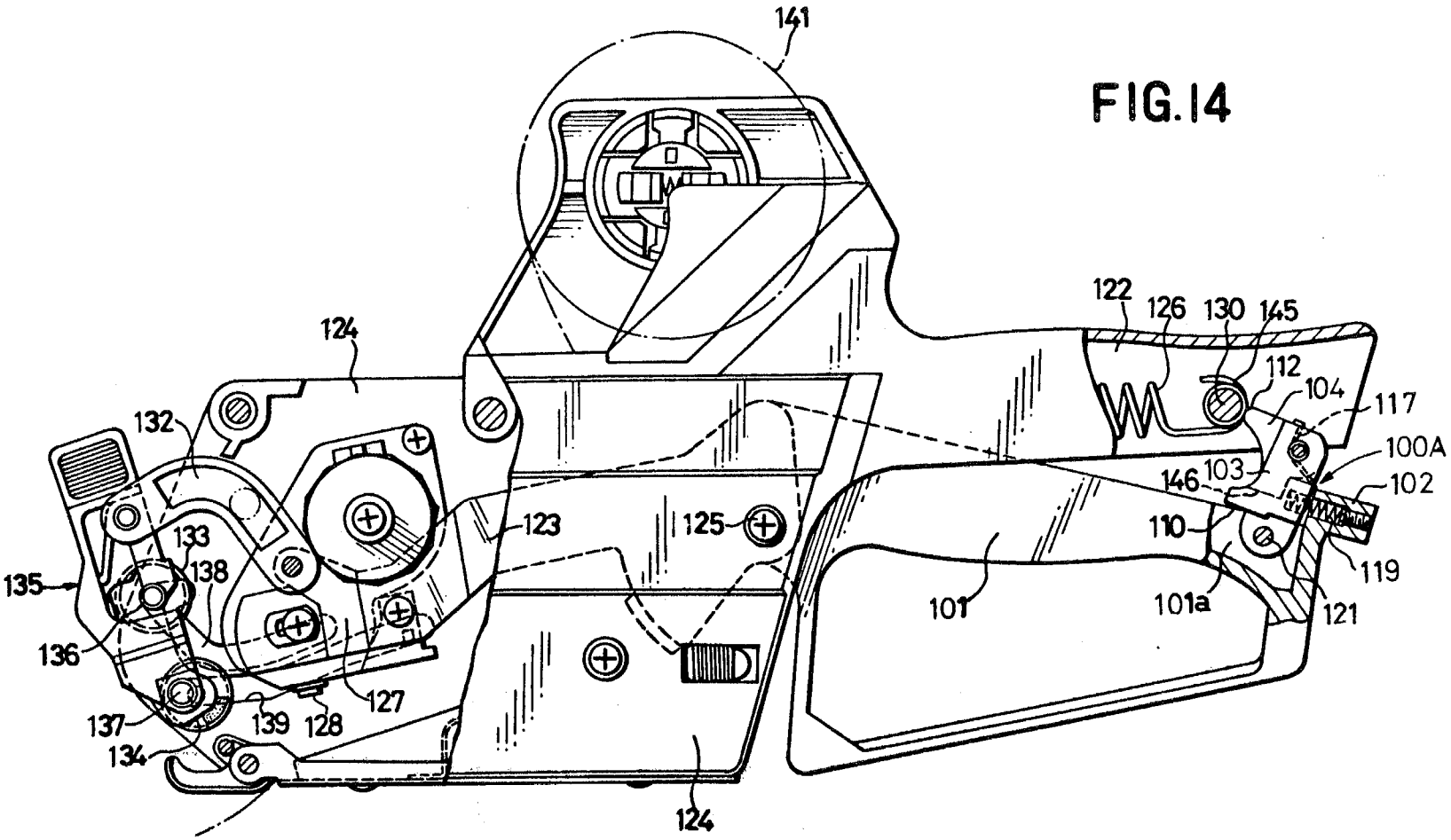

When the hand lever 101 is squeezed further, the hand lever 101 and the hand grip 122 come hear to each other as shown in FIG. 14. The upper front portion of the cam surface 112 formed on the pressure receiving piece 104 of the constant printing pressure mechanism 100A is brought into contact with the lower rear sides of the pressure rollers 145 that are attached to the spring pin 130 in the hand grip 122. Because the lower rear sides of the pressure rollers 145 forcibly push against the upper front portion of the cam surface 112, the pressure receiving piece 104 is urged to pivot counterclockwise. However, pressure receiving piece 104 does not turn counterclockwise at all because the undersurface 146 of the pressure receiving piece 104 is held in contact with the bottom surface 147 in the recess 107 of the pressure controlling member 103. As a result, the pressure on cam surface 112 is directly exerted on the pressure controlling member 103. The bearing hole 149 of the pressure controlling member 103 receives the shaft 121 which is pivotally secured to the side walls **101*a* of the hand lever 101. In addition, the lower surface of the forwardly projecting stopper 110 is in contact with the upper surface of the hand lever 101, so that the pressure controlling member 103 can be turned only in the clockwise direction. Therefore, as shown in FIG. 14, the pressure controlling member 103 is slightly turned clockwise (rearward) about the fulcrum of shaft 121 against the force of the adjusting spring 119 by the pressure of the pressure rollers 145. When the squeezing force on the hand grip 122 and the hand lever 101 exceeds the force of the adjusting spring 119, the cam surface 112 rides over the rear sides of the pressure rollers 145. This permits the hand lever 101** to be squeezed further.

Figure 15:
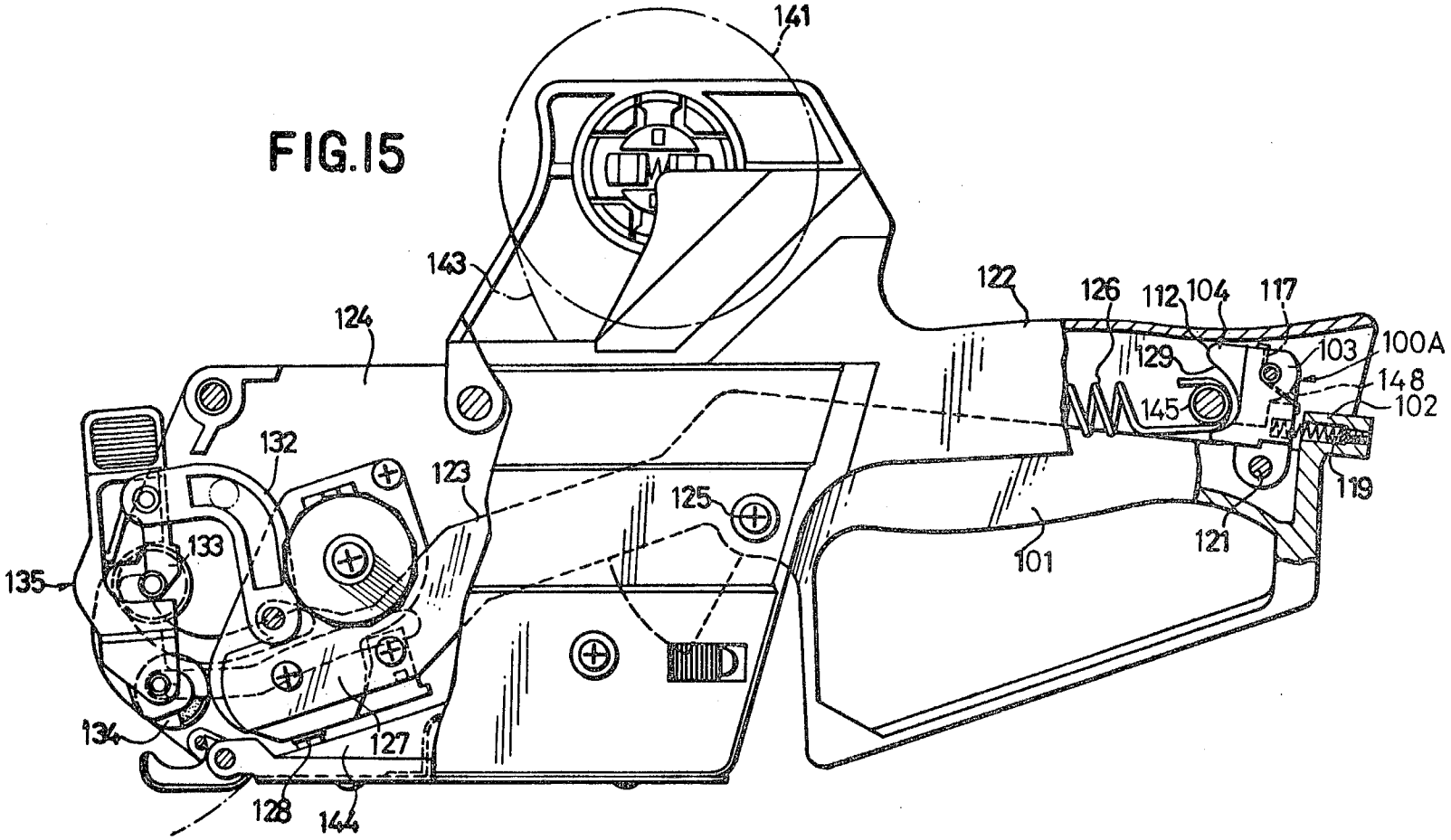
Figure 16:
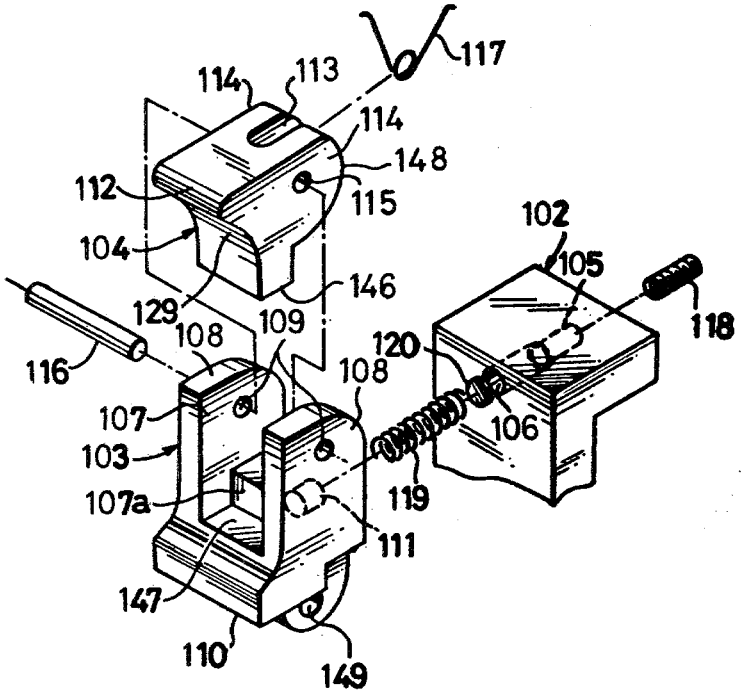

When the hand lever 101 is fully squeezed as shown in FIG. 15, the printing head 127 moves further downward, and the types 128 are brought into contact with the label strip 143 that is carried on the platen 144. Simultaneously with the printing of the label 143, the inking roller holder 135 and inking rollers 133 and 134 are shifted forward along the guide grooves 138 and 139 and they are pushed up along the front side of the machine body.

In the next step, when the hand lever 101 is released, the printing lever 123 is returned to the rest position of FIG. 13 by the contraction of the return spring 126. During the return operation, the pressure receiving piece 104 is turned clockwise since the curved surface 129 below the cam surface 112 comes into contact with the pressure rollers 145 and is guided clockwise by them. Since the pressure receiving piece 104 is provided with a rounded surface 148 on its lower rear side, the pressure receiving piece 104 is smoothly turned clockwise about the pin 116 against the force of the return spring 117. Accordingly, the hand lever 101 is returned to the rest position of FIG. 13 without resistance.

The force of the adjusting spring 119 against the pressure controlling member 103 can be controlled by moving the adjusting screw 118 along the screw hole 105 of the supporting member 102. This controls the intensity of squeezing that is necessary for the printing.

As described above, according to the present invention, label printing occurs only when the squeezing force on the hand lever exceeds the action of the adjusting spring.

The following benefits can be attained with the present invention:

(1) When the hand lever is squeezed quickly, the printing pressure is checked for a moment by the pressure receiving members. When the hand lever is squeezed too strongly, the force of squeezing is properly reduced by the above-described pressure receiving members. When the hand lever is squeezed slowly or weakly, the printing pressure is accumulated to a predetermined level by the pressure receiving members. Therefore, label printing is always performed at a certain constant pressure. Accordingly, high precision printing can be attained without unevenness in the depths of printed figures.

(2) The pressure receiving members may be made of a resilient material, such as synthetic plastic. The resilience of these pressure receiving members is utilized. The durability of these members is good, as compared with other elastic members, such as springs. Constant pressure printing can be assured for a long period of time.

(3) The pressure controlling arms in the pressure controlling section of the first and second embodiments are provided with adjusting screws that are brought into engagement with the fixed contact pin. Therefore, the strength of the resistance to the pressure roller, and the resultant strength of the printing stroke, can be controlled. Similarly, the pressure receiving piece of the third embodiment is adjustably spring controlled so as to control the strength of resistance to the pressure roller and the strength of the printing stroke.

(4) Further, the returning means in the second embodiment for retracting the printing head after the printing stroke can slightly raise the printing head from the platen immediately after the printing. Accordingly, it is possible to prevent the blurring of ink owing to too long contact of the type faces with the printed label surface and to avoid double printing caused by the rebounding of the printing head during the printing stroke.

(5) Since the constant printing pressure mechanism of the third embodiment of the present invention is mounted on the rear part of a label printing machine, it does not obstruct the space in the front portion of a printing head. Accordingly, it becomes possible to attach a plurality of type face inking rollers to the machine. Further, this space can also receive the pushing and guiding means for inking rollers. Therefore, the type faces are inked fully and evenly and quite clear printing can always be performed.

(6) Since the constant printing pressure mechanism of the third embodiment of the present invention is mounted on the rear part of a label printing machine, the space in front of the printed label applicator at the front of the machine is not obstructed and it becomes easy to apply printed labels to desired portions of articles.

(7) Further, in the third embodiment, since some portions of the hand lever and hand grip are parts of the constant printing pressure mechanism, the structure of the constant printing pressure mechanism can be made simple, and accordingly, constant pressure label printing machines can be produced at low cost.

(8) The constant printing pressure mechanisms of the present invention are especially suitable for a label printing machine that prints optically readable characters on labels used in a P.O.S. system.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A label printing machine, comprising:

a machine frame; a printing lever supported to be movable with respect to said machine frame; a printing head connected to said printing lever to be movable thereby; an operating lever rigidly connected to said printing lever for operating said printing lever in a print direction and in a return direction; said frame including a portion attached thereto toward which said operating lever is movable;

a platen opposable to said printing head; said printing head being movable to said platen upon movement of said printing lever in said print direction;

a constant printing pressure mechanism, comprising:

pressure applying means attached to said frame portion;

pressure receiving means attached on said operating lever to be movable with respect to said pressure applying means; said pressure receiving means being provided for being engaged by and being positioned to be engaged by said pressure applying means upon movement of said operating lever toward said frame portion; said pressure receiving means being adapted to resist its movement past said pressure applying means until said pressure applying means applies more than a predetermined pressure thereto and said pressure receiving means then passing said pressure applying means, whereupon said printing head is thereafter freed by said pressure receiving means to move to said platen for printing a label.

2. The label printing machine of claim 1, wherein engagement between said pressure receiving means and said pressure applying means is resilient and motion of said pressure receiving means past said pressure applying means is resiliently resisted until said predetermined pressure is exceeded.

3. The label printing machine of claim 2, wherein said pressure receiving means is resilient and is urged upon engagement under pressure with said pressure applying means to cause said operating lever to move away from said frame portion.

4. A label printing machine, comprising:

a machine frame; a printing lever supported to be movable with respect to said machine frame; a printing head connected to said printing lever to be movable thereby; an operating lever rigidly connected to said printing lever for operating said printing lever in a print direction and in a return direction; said frame including a portion attached thereto toward which said operating lever is movable;

a platen opposable to said printing head; said printing head being movable to said platen upon movement of said printing lever in said print direction;

a constant printing pressure mechanism, comprising:

pressure applying means attached to said frame portion;

pressure receiving means attached on said operating lever to be movable with respect to said pressure applying means; said pressure receiving means being provided for being engaged by and being positioned to be engaged by said pressure applying means upon movement of said operating lever toward said frame portion; said pressure receiving means comprises:

a pressure controlling member pivotally supported on said operating lever and pivotable with respect to said operating lever toward and away from said pressure applying means; biasing means for urging said pressure controlling member to pivot toward said pressure applying means; first abutment means for positioning the biased said pressure control member at a predetermined location with respect to said pressure applying means, such that said pressure applying means engages said pressure receiving means when said operating lever moves toward said frame portion; said pressure receiving means being so placed with respect to said pressure applying means that engagement therebetween under pressure urges said pressure controlling member to pivot against the bias of its said biasing means;

whereby said pressure receiving means being adapted to resist its movement past said pressure applying means until said pressure applying means applies more than a predetermined pressure thereto and said pressure receiving means then passing said pressure applying means, whereupon said printing head is thereafter freed by said pressure receiving means to move to said platen for printing a label.

5. The label printing machine of claim 4, wherein said pressure receiving means further comprises a supporting member on said operating lever; said biasing means extending between said supporting member and said pressure controlling member.

6. The label printing machine of claim 4, wherein said pressure receiving means further comprises a pressure receiving piece attached to said pressure controlling member; said pressure receiving piece being the part of said pressure receiving means against which said pressure applying means engages.

7. The label printing machine of claim 4, wherein said operating lever is rigidly connected to said printing lever to move together therewith.

8. A label printing machine comprising:

a machine frame; a printing lever supported to be movable with respect to said machine frame; a printing head connected to said printing lever to be movable thereby; an operating lever rigidly connected to said printing lever for operating said printing lever in a print direction and in a return direction; said frame including a portion attached thereto toward which said operating lever is movable;

a platen opposable to said printing head; said printing head being movable to said platen upon movement of said printing lever in said print direction;

a constant printing pressure mechanism, comprising:

pressure applying means attached to said frame portion;

pressure receiving means attached on said operating lever to be movable with respect to said pressure applying means; said pressure receiving means being provided for being engaged by and being positioned to be engaged by said pressure applying means upon movement of said operating lever toward said frame portion; said pressure receiving means comprises:

a pressure controlling member pivotally supported on said operating lever and pivotable with respect to said operating lever toward and away from said pressure applying means; biasing means for urging said pressure controlling member to pivot toward said pressure applying means; first abutment means for positioning the biased said pressure control member at a predetermined location with respect to said pressure applying means, such that said pressure applying means engages said pressure receiving means when said operating lever moves toward said frame portion; said pressure receiving means being so placed with respect to said pressure applying means that engagement therebetween under pressure urges said pressure controlling member to pivot against the bias of its said biasing means;

said pressure receiving means further comprises a pressure receiving piece attached to said pressure controlling member; said pressure receiving piece being the part of said pressure receiving means against which said pressure applying means engages; said pressure receiving piece is pivotally attached to said pressure controlling member for pivoting with respect thereto toward and away from said pressure applying means; second biasing means for biasing said pressure receiving piece with respect to said pressure controlling member to an engagement position, at which said piece is engaged by said pressure applying means, second abutment means for preventing said pressure receiving piece from further pivoting beyond said engagement position under the bias of said second biasing means;

said pressure receiving piece incuding a cam surface positioned in the pathway of and for engaging said pressure applying means when said operating lever is moved toward said frame portion, and said cam surface being so shaped and positioned that pressure thereupon by said pressure applying means urges said pressure receiving piece with greater force against said second abutment means, and this, in turn, pivots said pressure controlling member, against the force of said first biasing means, away from said pressure applying means, thereby to eventually permit said pressure receiving piece cam surface to ride over and pass said pressure applying means;

whereby said pressure receiving means being adapted to resist its movement past said pressure applying means until said pressure applying means applies more than a predetermined pressure thereto and said pressure receiving means then passing said pressure applying means, whereupon said printing head is thereafter freed by said pressure receiving means to move to said platen for printing a label.

9. The label printing machine of claim 8, wherein said pressure receiving means further comprises a supporting member on said operating lever; the first said biasing means extending between said supporting member and said pressure controlling member.

10. The label printing machine of claim 8, wherein said pressure receiving piece includes a second cam surface located beneath the first said cam surface with respect to the motion of said operating lever, such that when said pressure applying means passes the first said cam surface, it engages said second cam surface; said second biasing means urging said pressure receiving piece to move for engaging said pressure receiving piece second cam surface against said pressure applying means; said second cam surface being shaped such that engagement thereof with said pressure applying means blocks movement of said operating lever away from said frame portion and such that such movement of said operating lever away from said frame portion pivots said pressure receiving piece with respect to said pressure controlling member away from a position blocking said pressure applying means and against the bias of said second biasing means.

11. The label printing machine of claim 10, wherein said pressure receiving means further comprises a supporting member on said operating lever; the first said biasing means extending between said supporting member and said pressure controlling member.

12. The label printing machine of claim 10, wherein said pressure applying means comprises a roller attached to said frame portion.

13. The label printing machine of claim 10, wherein said pressure receiving piece is shaped such that said first cam surface is generally opposed to said pressure applying means when said operating lever is away from said frame portion and said second cam surface generally faces in the opposite direction from said first cam surface, and said second cam surface being directed such that upon movement of said operating lever away from said frame portion with said pressure applying means in engagement with said second cam surface, such movement causes said second cam surface and said pressure receiving piece to pivot in the direction away from said pressure applying means.

14. The label printing machine of claim 13, wherein said pressure applying means comprises a roller attached to said frame portion.

15. The label printing machine of claim 14, wherein said pressure receiving means further comprises a supporting member on said operating lever; the first said biasing means extending between said supporting member and said pressure controlling member.

* * * * *